United States Patent [19]

Ball et al.

[11] Patent Number: 4,902,345

[45] Date of Patent: Feb. 20, 1990

[54] TREATMENT OF REFRACTORY CARBONACEOUS AND SULFIDIC ORES OR CONCENTRATES FOR PRECIOUS METAL RECOVERY

[75] Inventors: Brian Ball; Rong-Yu Wan, both of Salt Lake City, Utah

[73] Assignee: Newmont Gold Co., Carlin, Nev.

[21] Appl. No.: 296,486

[22] Filed: Jan. 12, 1989

[51] Int. Cl.[4] ..... C22B 11/04

[52] U.S. Cl. ..... 75/118 R; 75/101 R; 75/103; 423/27; 423/32; 204/109

[58] Field of Search ..... 75/101 R, 118 R, 103; 423/27, 32; 204/109

[56] References Cited

U.S. PATENT DOCUMENTS

| | | | |
|---|---|---|---|
| 4,145,212 | 3/1979 | Bodson | 75/118 R |
| 4,259,107 | 3/1981 | Guay | 423/29 |
| 4,289,532 | 9/1981 | Matson et al. | 75/118 R |
| 4,552,589 | 11/1985 | Mason et al. | 423/29 |
| 4,561,947 | 12/1985 | Schluze | 204/109 |
| 4,629,502 | 12/1986 | Sherman et al. | 423/31 |
| 4,738,718 | 4/1988 | Bakshani et al. | 423/31 |
| 4,778,519 | 10/1988 | Pesic | 423/27 |
| 4,801,329 | 1/1989 | Clough et al. | 423/31 |

*Primary Examiner*—Robert L. Stoll

*Attorney, Agent, or Firm*—Fred A. Keire

[57] ABSTRACT

The recovery of precious metals from refractory carbonaceous and sulfidic ores or concentrates is improved by subjecting an oxidized slurry of this type of ore to thiourea leaching in the presence of carbon instead of subjecting the slurry to cyanidation leaching.

11 Claims, No Drawings

TREATMENT OF REFRACTORY CARBONACEOUS AND SULFIDIC ORES OR CONCENTRATES FOR PRECIOUS METAL RECOVERY

This invention relates to the improved recovery of precious metals from refractory ores; more particularly, this invention relates to a method to use thiourea and like compounds in combination with carbon-in-pulp or carbon-in-leach recovery of gold. A refractory ore is one which will not readily allow precious metal extraction therefrom by prior art methods of cyanidation, and typically contain carbonaceous components, as well as carbon and sulfidic components, in the mineral composition of this ore.

BACKGROUND OF THE INVENTION

This invention relates to the recovery of precious metals from carbonaceous and sulfidic ores or concentrates which are refractory to standard cyanidation techniques. In the context of this disclosure, "refractory ore" is one which will not readily allow precious metal extraction therefrom by direct cyanidation, nor, in some cases, by carbon-in-leach cyanidation (CIL) or carbon-in-pulp (CIP) cyanidation. The invention relates, more particularly, to an improved process for the treatment of these ores to obtain consistently high precious metal recoveries.

In the recovery of precious metals from mineral sources with which the precious metal is associated, a number of steps and combinations of steps have been proposed to improve the yield. As recoverability is a function of the refractoriness of the ore, any added step must be economically justifiable in the recovery of additional amounts of, e.g., gold.

An ore that is refractory due to its carbonaceous content can often be treated by chlorination prior to carbon-in-leach cyanidation. This has been done commercially for a number of years using 40 to 100 lbs. of chlorine gas per ton of ore. As the amount of carbonaceous material increases, so does the amount of chlorine gas consumed. A point is soon reached, however, wherein the process is not economically feasible.

An ore that is refractory due to its sulfide content can often be treated by various oxidation pre-treatments prior to cyanidation or carbon-in-leach cyanidation. Commercial pre-treatment schemes include roasting, autoclaving in the presence of oxygen-containing gas and bacterial leaching.

An ore that is refractory due to both its carbonaceous and sulfide content represents a more complex problem. Chlorination followed by carbon-in-leach cyanidation will extract most of the precious metals, e.g., gold, but requires an exorbitant amount of chlorine gas. For example, from 400 to 900 lbs. of chlorine gas per ton of ore may be required. Roasting followed by carbon-in-leach cyanidation typically will extract 80% to 85% of the gold in the ore, but this often requires roasting temperatures of 650° C. Autoclaving in presence of oxygen followed by carbon-in-leach cyanidation will extract 70% to 80% of the gold in the ore, as will bacterial leaching.

The standard method in the industry for extracting precious metals such as gold from these ores is cyanidation. Cyanidation, carbon-in-leach cyanidation and carbon-in-pulp cyanidation have been coupled with various pre-treatment procedures in attempts to improve the results of the recovery of precious metals. A number of these pre-treatment steps have been carried out under atmospheric conditions or in an autoclave. Some of the shortcomings of these prior art pre-treatments have included the undue consumption of the materials with which the ore has been treated and other unacceptable consequences in subsequent treatment steps. Additional shortcomings have been an undue increase in the leaching time and temperature constraints which are unacceptable for the recovery of precious metals.

The potential or ultimate amount of precious metal in the ore which could be recovered is a goal against which all attempts have been measured. This ultimate goal has eluded many attempts, especially on an industrial scale, and has been an incentive for a number of investigations. Such potentially complete recovery, although often alleged, has been mere speculation or economic nonsense. Hence, with respect to the autoclave pre-treatment with oxygen coupled with carbon-in-leach or carbon-in-pulp cyanidation, various pre-treatments have fallen short of a complete exhaustion or substantially complete exhaustion of precious metal in the ore.

THE PRIOR ART

The degree of recoverability of gold is still influenced by and is a function of sulfides, the metal content of the ore associated with sulfides and, more importantly, the carbonaceous and carbon compound content of the ore. Thus, with an increase of sulfide sulfur and e.g. organic carbon, all other conditions being equal, the refractoriness of the ore increases. As noted above, a refractory ore is one that will not readily allow precious metal extraction therefrom by direct cyanidation.

A considerable effort has been devoted to the recovery of increasingly greater amounts of precious metals from these refractory ores. Such efforts have been illustrated, for example, in U.S. Pat. No. 4,259,107, and the prior art mentioned therein.

Similarly, U.S. Pat. No. 4,038,362 likewise discloses prior art methods and discusses these methods. This discussion is in the context of the prior attempts which have sought to increase the recovery of gold from organic carbonaceous sulfide ores. Other efforts have been illustrated in U.S. Pat. Nos. 3,574,600 and 3,639,925.

U.S. Pat. No. 4,289,532 discloses oxygen gas oxidation of carbonaceous gold containing ores in an alkaline medium followed by chlorination of the ore. Use of an alkaline medium has been asserted to be a critical requirement in the process.

*Technology News,* from the Bureau of Mines, U.S. Dept. of the Interior, No. 317, 1988, also discloses that the Bureau of Mines has developed a chloride-oxygen leaching to recover metal values from complex sulfide ores and other feed materials. Similarly, U.S. Pat. No. 4,410,496 discloses a process for recovering metal values from sulfide ores or concentrates by treating a slurry of the ores and concentrates in an aqueous solution of calcium chloride or barium chloride with gaseous oxygen at elevated temperatures; and U.S. Pat. No. 4,053,305 discloses a process for recovering copper and silver from complex sulfide ores or concentrates by leaching with a combination of ferrous chloride and oxygen.

U.S. Pat. No. 4,552,589 discloses a process for recovering precious metals from a refractory ore which comprises subjecting a partially oxidized slurry of the ore to a carbon-in-cyanide leach treatment to separate the precious metals.

U.S. Pat. No. 4,571,263 discloses an acidic pretreatment step to decompose carbonates in an otherwise conventional process for recovering gold from refractory concentrates.

U.S. Pat. No. 4,578,163 discloses a process for treating refractory ores which combines a pressure oxidation step, a multiple stage washing step to remove excess acid and heavy metals generated during the pressure oxidation and a cyanidation and carbon-in-pulp recovery step.

U.S. Pat. No. 4,605,439 discloses a process for recovering gold from refractory materials wherein the problems caused by the presence of molten sulphur are said to be overcome by adding inert solids to provide a high slurry pulp density.

Finally, U.S. Pat. No. 4,738,718 discloses a gold recovery pretreatment process using sulfidic ores wherein soda ash is added before oxidation. The oxidized ore is then subjected to conventional gold extraction techniques.

Despite gold extractions in the range of 70% to 80%, a drawback common to most of these prior art methods is that an extremely acidic pulp is produced, sometimes as low as pH of about 0 and almost always at a pH less than or equal to 2. The subsequent cyanidation or carbon-in-leach cyanidation is almost always carried out at pH of 10 or higher. Thus, a neutralization step using large quantities of lime, limestone, or the like, is required.

There are also references which suggest using thiourea to extract precious metals from ores and pulps. For example, Yen et al., in a paper presented at the 17th Canadian Mineral Processors Operators Conference, Jan. 22–24, 1985, in Ottawa, Ontario, disclosed using thiourea to extract gold from a pressure oxidation pulp cooled to below 40° C. after $SO_2$ conditioning.

French Pat. No. 2,476,137 discloses a leaching operation comprising (i) pre-leaching with a sulphuric acid solution in the presence of $SO_2$ followed by (ii) leaching with an acidic thiourea solution to obtain good yields of silver and gold.

U.S. Pat. No. 4,342,591 discloses a process for recovering gold and/or silver and possibly bismuth contained in a sulfuretted ore and/or sulfoarsenides wherein the ores are treated to a reducing roasting, an oxidising roasting, a possible crushing, a first lixiviation with sulfuric acid, a second lixiviation with thiourea and a cementation.

However, none of these references teach or suggest leaching the precious metals with thiourea in the presence of carbon as disclosed herein.

In a companion application, Ser. No. 264,632 assigned to the same assignee and which is incorporated by reference herein, a combination of steps in a process also has been disclosed in which the treatment balances, in a more economically advantageous manner, the pretreatment steps with gold extraction.

BRIEF DESCRIPTION OF THE INVENTION

It has now been discovered that an improved process for precious metal recovery may be practiced. Thus, increased yields have been achieved and other prior art shortcomings minimized when thiourea, in the presence of carbon, is used instead of cyanide to extract precious metals from refractory ores in processes which comprise various pre-treatment steps in combination with the precious metal extraction step. Moreover, since the pulp is typically acidic as a result of pre-treatment and thiourea leaching is most often carried out at a pH of 1 to 2, no neutralization step using large quantities of lime, limestone, or the like, is required. Additionally, unlike cyanidation, thiourea leach is substantially non-toxic.

DETAILED DESCRIPTION OF THE INVENTION

In refractory ores which contain organic and inorganic carbonaceous materials and sulfide minerals, the recovery of precious metals such as gold is highly dependent upon the carbon and metal sulfide content of the ore. Even with the best prior art pre-treatments, the practical recovery rates which have been achieved have been in the order of about 70% to 80%, based on the total amount of the gold present, as defined by the standard assay method of analysis. This level has been achieved if the sulfide sulfur content and organic carbon content have not been excessively high, and proper economical pre-treatment steps have been followed. On the other hand, the amount of precious metals extracted, e.g. gold, decreases if metal sulfide and/or carbon content increases in the ore. Further, even if there is a substantial increase in gold content in the ore, the amount of extraction does not necessarily increase if the amount of pyrite sulfide is excessively high.

Thus, in accordance with the present invention, a series of runs were conducted which establish unique and heretofore unachieved results. Needless to say, the economic advantages are sizeable if gold extraction can be improved while, at the same time, overall treatment costs may be decreased.

The ore which was used to achieve the above improvements came from a random sample of sulfidic-organic carbon-containing gold bearing ores from the region around Carlin, Nev. A typical analysis of this ore shows that it is about 70% quartz, 14% illite, 4% kaolinite, 4% alunite, 2% barite and 1% $FeO_x$ pyrites, etc. (All percentages in this application are by weight unless otherwise specified.) The assay value for this ore is typically about 0.2 ounces of gold per ton of ore. This ore, if treated, shows gold recovery by simple carbon-in-leach cyanidation of 9%. Gold recovery by carbon-in-leach cyanidation following pressure oxidation is 55%-70% depending on the oxidation conditions.

In this ore, total sulfur is about 2.3%, and sulfide sulfur is about 2.0%. Total carbon is about 0.9%, of which organic carbon is about 0.75%. Iron is about 2.25%. There are other small amounts of metals present such as zinc, arsenic, strontium, rubidium, barium, vanadium and titanium, e.g., up to about 1.2% to 1.3%, total.

The process for the recovery of precious metals from these sulfidic-carbonaceous ores according to the invention includes the following steps:

(a) forming an aqueous slurry of the ores or concentrates;

(b) subjecting the aqueous slurry to a pre-treatment in an autoclave with oxygen and with chlorine or chlorine equivalents or without chlorine pre-treatment;

(c) leaching the precious metals with thiourea in the presence of carbon; and (d) recovering the precious metals.

Typically, the ore pulp for which this invention is effective is any refractory ore pulp with a pH of 4 and below, or which can be reasonably adjusted thereto, before the pretreatment in an autoclave with oxygen.

Small amounts of dolomite, calcite or other carbonate minerals may be present. The ore is typically wet ground with water to yield a slurry containing the ore in a mesh size of about 60%±10%-200 mesh. It is thereafter pulped to the point wherein it contains from about 20 to about 50% by weight of solids, preferably 40%; the slurry is heated and treated in an autoclave at a temperature between about 110° and 120° C. and up to about 250° C. in the presence of oxygen (the $O_2$ overpressure is typically 100 to 200 psi) for 1 to 6 hours; the oxidized aqueous slurry is cooled to about 20° to 60° C., preferably from about 30° to 50° C.; and the precious metal is extracted from the oxidized aqueous slurry with thiourea in the presence of carbon.

Ferric ion is desirably present in the autoclaved product or else is added as ferric sulphate when treating the slurry with thiourea. Although the reason for the use of ferric ion as an oxidizing agent is subject to speculation, ferric ion addition is highly advisable. Typically, 0 to 10 gr/liter, usually 5 gr/liter, is added if required. A reducing agent such as $SO_2$, $NaHSO_3$, or mistures thereof may also be added to control the oxidation potential (emf) during thiourea leach.

The following examples illustrate the process of the present invention and its improvements as disclosed herein with respect to recovery of gold.

EXAMPLE 1

A comparative series of tests was done directly comparing carbon-in-cyanidation leach to carbon-in-thiourea leach on a sample which had been autoclaved in the presence of oxygen at 180° C. for two hours. The following gold extractions were obtained:

| | C-I-Cyn | C-I-Tu | C-I-Tu |
|---|---|---|---|
| Carbon (grams per liter) | 28 | 20 | 40 |
| % Extraction | 71 | 80 | 86 |

A second series of tests was done and the following results were obtained:

| | C-I-Cyn | C-I-Tu | C-I-Tu |
|---|---|---|---|
| Carbon (grams per liter) | 28 | 20 | 20 |
| % Extraction | 72 | 85 | 82 |

The process conditions for the series of test were as follows—

Temperature: 40° C. Typically temperature may range from 20° to 60° C.

Amount of thiourea present: 10 gr/liter. Typically amounts of thiourea are from 2 to 20 gr/liter, with a preferred range of 5 to 12 gr/liter.

pH: about 1.0. The process may be conducted over a pH range from 0.5 to 2.5, with a preferred range of 1.0 to 1.5.

Leach time: 2 hours. Typically leach time may range from 1 to 6 hours.

Carbon as used in the above examples was in the form of 6×12 mesh North American Coconut Carbon. Typically, carbon is used at a level of 10 to 40 gr/liter, especially 20 gr/liter. Carbon may also be used in the form 6×12 mesh activated coconut shells or extruded peat (Norit 3515). These are often interchanged. In the above example tests, ferric ion was present in the amount of 5 gr/liter.

The carbon-in-thiourea tests gave higher gold extraction with less carbon present, shorter leach times and no neutralization step using large quantities of lime, limestone or the like.

While the above runs have been presented to report a true and proper comparison, obviously there are a number of variations that can be made. The autoclave pretreatment may vary as to percent solids, acid content, temperature, oxygen overpressure, viscosity modifiers, acid pre-treatments, etc.

With respect to the pretreatment steps, the disclosure from the prior companion application is incorporated herein by reference.

In all cases where the present process has been practiced, it has been found that it gives end results which favorably compare to any of the end results advanced by the prior art cyanidation with CIL or CIP additions. Moreover, the process steps disclosed herein fall into the realm of practical technology which can be readily carried out on a large scale.

The foregoing examples are considered to be representative of the principles of the instant invention, but are given here as illustrations only and should not be interpreted as limiting the scope of the invention. Obviously, many modifications which fall within the scope of the invention will be apparent to those skilled in the art.

What is claimed is:

1. A method for the recovery of a precious metal from carbonaceous and sulfidic ores or concentrates which comprises:

(a) forming an aqueous slurry of said ores or concentrates;

(b) pretreating said aqueous slurry in an autoclave with an oxygen-containing gas;

(c) leaching said precious metal with thiourea in the presence of added carbon; and (d) recovering said precious metal.

2. The method as defined in claim 1, wherein said pretreating is with sufficient oxygen overpressure at a temperature and time sufficient to oxidize pyritic sulfides and sulfides associated with metallic components in said ores or concentrates.

3. The method as defined in claim 2 wherein chlorine gas, chlorite or a chemical agent which will supply chlorine to said aqueous slurry is used as a supplement to the pre-treatment.

4. The method as defined in claim 2, wherein said precious metal is gold.

5. The method as defined in claim 4, wherein said pretreating in an autoclave is for 2 hours at between about 110° and 250° C.

6. The method as defined in claim 4, wherein the recovery is from ore which contains base metal sulfides and carbonaceous material.

7. The method as defined in claim 4, wherein the recovery is from concentrates which contain at least about 2.0% by weight sulfide sulfur and a least 0.75% by weight organic carbon.

8. The method as defined in claim 4, wherein the ore is wet ground with water to yield a slurry containing said ore in a mesh size of about 60% of −200 mesh; said ore is thereafter pulped to wherein the sam contains from about 40 to about 50% by weight of solids; said slurry is heated and treated in an autoclave at a temperature between about 110° and 250° C. in the presence of oxygen; the oxidized aqueous slurry is cooled to about 20° to 60° C.; and gold is extracted from said oxidized aqueous slurry with thiourea in the presence of carbon.

9. The method as defined in claim 8 wherein the concentration of thiourea is from 2 grams/liter to 20 gram/liter in the slurry.

10. The method as defined in claim 4 wherein ferric ion is added when the precious metal is leached with thiourea in the presence of carbon.

11. The method as defined in wherein a reducing agent is added to control the oxidation potential when the precious metal is leached with thiourea in the presence of carbon.

* * * * *